US006050365A

United States Patent [19]

Newlin

[11] Patent Number: 6,050,365

[45] Date of Patent: Apr. 18, 2000

[54] SCISSORS-TYPE WORK PLATFORM LIFT MACHINE WITH ELECTRO-MECHANICAL BASED LIFT ACTUATION ARRANGEMENT

[75] Inventor: Enoch L. Newlin, Waynesboro, Pa.

[73] Assignee: Zefer Operations, Inc., Fairfield, Pa.

[21] Appl. No.: 09/063,809

[22] Filed: Apr. 21, 1998

Related U.S. Application Data

[60] Provisional application No. 60/044,522, Apr. 22, 1997.

[51] Int. Cl.[7] ..... E06C 1/00

[52] U.S. Cl. ..... 182/69.5; 182/14; 182/63.1; 182/69.6; 182/148; 52/109

[58] Field of Search ..... 182/12, 13, 14, 182/16, 63.1, 69.1, 69.2, 69.3, 69.5, 69.6, 141, 148; 52/109; 254/122; 403/78, 127

[56] References Cited

U.S. PATENT DOCUMENTS

| | | | |
|---|---|---|---|
| Re. 28,455 | 7/1975 | Denier et al. | 182/69.5 X |
| 1,042,662 | 10/1912 | Fillion . | |
| 1,498,813 | 6/1924 | Sankela et al. | 187/269 |
| 1,545,223 | 7/1925 | Westlate . | |
| 2,188,686 | 1/1940 | Kersting et al. | 187/269 |
| 2,445,004 | 7/1948 | Reynolds et al. | 187/269 |
| 2,975,868 | 3/1961 | Long | 187/18 |
| 3,064,751 | 11/1962 | Nemecek et al. | 403/127 X |
| 3,373,844 | 3/1968 | Schafer | 182/69.1 X |
| 3,817,346 | 6/1974 | Wehmeyer | 182/69.5 X |
| 3,920,096 | 11/1975 | Fisher | 182/148 X |
| 4,070,807 | 1/1978 | Smith, Jr. | 182/69.5 X |
| 4,088,203 | 5/1978 | Smith, Jr. | 182/69.5 X |
| 4,130,178 | 12/1978 | Smith, Jr. | 182/69.5 X |
| 4,405,116 | 9/1983 | Eisenburg | 254/122 |
| 4,546,852 | 10/1985 | Martin et al. | 182/69.5 X |
| 4,725,183 | 2/1988 | Smillie, III | 414/345 |
| 4,768,601 | 9/1988 | Okano | 180/24.07 |
| 4,867,277 | 9/1989 | Sloan | 187/9 E |
| 4,930,598 | 6/1990 | Murrill et al. | 182/69.5 |
| 4,986,688 | 1/1991 | Tuan et al. | 403/127 |
| 5,125,280 | 6/1992 | Koscinski et al. | 74/89.15 |
| 5,335,407 | 8/1994 | Verkerk | 29/426.3 |
| 5,379,855 | 1/1995 | Juang | 187/269 |

*Primary Examiner*—Daniel P. Stodola
*Assistant Examiner*—Richard M. Smith
*Attorney, Agent, or Firm*—Michael R. Swartz; John R. Flanagan

[57] ABSTRACT

A scissors-type work platform lift machine includes a mobile chassis having rear stationary wheels and front steerable wheels, a scissors lift mechanism mounted at a lower end on the chassis, a work platform mounted on an upper end of the lift mechanism, and an electro-mechanical actuation arrangement for operating the lift mechanism between retracted and expanded conditions so as to move the work platform between lowered and raised positions. The electro-mechanical actuation arrangement is mounted to and extends between the mobile chassis and the lower end of the lift mechanism and has a ballscrew shaft operable to rotate in a first angular direction and cause movement of the lift mechanism vertically toward the retracted condition and thereby movement of the work platform toward the lowered position and to rotate in a second angular direction opposite to the first angular direction and cause movement of the lift mechanism vertically toward the expanded condition and thereby movement of the work platform toward the raised position. The actuation arrangement also has an upper joint pivotally and threadably coupling an upper portion of the ballscrew shaft to the lower end of the lift mechanism and a lower joint coupling a lower portion of the ballscrew shaft to the chassis for undergoing limited universal pivotal movement relative thereto. The actuation arrangement further includes an electric motor drivingly coupled to the lower portion of the ballscrew shaft below the lower joint.

25 Claims, 6 Drawing Sheets

SCISSORS-TYPE WORK PLATFORM LIFT MACHINE WITH ELECTRO-MECHANICAL BASED LIFT ACTUATION ARRANGEMENT

This application claims the benefit of provisional application Ser. No. 60/044,522, filed Apr. 22, 1997.

BACKGROUND OF THE INVENTION

1. Field of the Invention

The present invention generally relates to work platform lift machines and, more particularly, is concerned with a scissors-type work platform lift machine with an electro-mechanical based lift actuation arrangement.

2. Description of the Prior Art

In various work platform lift machines, such as scissors lifts, elevated platforms, cranes, etc., hydraulic cylinders are used to provide the necessary lifting forces. One of most popular machines of this type in use is called an electric slab scissor lift machine. Electric slab scissor lift machines commercially available at present time from several manufacturers include a battery powered chassis having rear stationary wheels and front steerable wheels, a scissors lift mechanism mounted at a lower end on the chassis, a work platform mounted on an upper end of the lift mechanism for carrying workmen, and a hydraulic actuation system for operating the lift mechanism to raise and lower the work platform. The scissors lift mechanism includes a plurality of sets of arms pivotally interconnected in a scissor-like fashion so as to raise and lower as the arms pivot between generally vertical unstacked and horizontal stacked orientations relative to one another. The hydraulic actuation system generally employs one or more hydraulic cylinders for causing pivoting of the sets of arms to expand the lift mechanism by unstacking the sets of arms and thereby raise the work platform or to retract the lift mechanism by restacking the pairs of arms and thereby lower the work platform. Typically, the hydraulic cylinders are interconnected between an adjacent set of the arms.

The use of hydraulic actuation systems and positioning of the hydraulic cylinders in lift machines have several disadvantages. One major disadvantage is that hydraulic actuation systems leak hydraulic fluid which is a substance toxic to the environment and therefore requires a considerable amount of care and attention and must be contained and disposed of properly. In food, aerospace, pharmaceutical, silicon chip and other industries, cleanliness is very important and thus hydraulic fluid leakage and contamination cannot be tolerated. Another significant disadvantage of hydraulic actuation systems is that they are not very efficient, typically operating at levels ranging from fifty to sixty percent efficiency. Thus, lift machines that are hydraulically powered not only invite high maintenance and/or repair costs but also tend to tax the batteries that are used to drive the machines resulting in short run times before the batteries need to be recharged. Yet another important disadvantage is that using hydraulic cylinders within the scissors arm stack to raise the lift mechanism and thereby the work platform not only causes machine instability due to high centers of gravity, but also such hydraulic cylinders tend to be squishy and jerky in operation and thus hydraulic actuation systems lack smooth and precise control of the movement of the lift mechanism to raise and lower the working platform.

Consequently, a need exists for a different approach to actuation of the scissors lift mechanism of such lift machines which will overcome the above-mentioned disadvantages without introducing other disadvantages in their place.

SUMMARY OF THE INVENTION

The present invention provides a scissors-type lift machine designed to satisfy the aforementioned need by totally eliminating the use of a hydraulic actuation system for operating the scissors lift mechanism and introducing in its place an electro-mechanical based actuation arrangement. The environmental problems caused by hydraulic fluid leakage and the maintenance problems associated therewith are avoided by the use of an electro-mechanical based lift mechanism actuation arrangement. The electro-mechanical based actuation arrangement provided by the present invention operates with an efficiency rating ranging from eighty to ninety percent, a substantially higher efficiency than that of the hydraulic based actuation system. Further, the electro-mechanical based actuation arrangement avoids the squishy and jerky operation of and "bounce" associated with the hydraulic actuation system by enabling a lifting motion that is smooth in operation and provides precise and definite control of operation. Additionally, the electro-mechanical actuation arrangement is mounted on the chassis and lift mechanism so as to reduce the center of gravity of the machine and make it more stable. Still further, the electro-mechanical actuation arrangement provides an unique lift geometry which reduces the lifting stresses on the pivotal scissors arms from around 35,000 pounds or more, as typically found on current scissors-type lift machines, down to only 5,000 to 17,000 pounds. This very large reduction in stress provides significant performance and maintenance advantages not only in the components of the machine itself but also reduces the demand on the electrical power supply. In summary, the overall benefits of the unique design of the present invention include enhancements in the areas of safety, stability and capacity.

Accordingly, the present invention is directed to a scissors-type work platform lift machine which comprises: (a) a chassis; (b) a scissors lift mechanism having an upper end and a lower end mounted on the chassis; (c) a work platform mounted on the upper end of the lift mechanism; and (d) an electro-mechanical actuation arrangement for operating the lift mechanism between retracted and expanded conditions so as to move the work platform between lowered and raised positions, the electro-mechanical actuation arrangement being mounted to and extending between the chassis and the lower end of the lift mechanism and being operable to rotate in a first angular direction and cause movement of the lift mechanism vertically toward the retracted condition and thereby movement of the work platform toward the lowered position and to rotate in a second angular direction opposite to the first angular direction and cause movement of the lift mechanism vertically toward the expanded condition and thereby movement of the work platform toward the raised position. The chassis includes rear stationary wheels and front steerable wheels and is thereby mobile.

The lift mechanism extends vertically between the chassis and the work platform. The lift mechanism includes a plurality of sets of arms pivotally interconnected in a vertically extending scissor-like fashion with a lower one of the sets of arms pivotally and movably mounted on the chassis and an upper one of the sets of arms pivotally and movably mounting the work platform such that pivoting of the sets of arms relative to one another causes the lift mechanism to move vertically between the retracted condition in which the work platform is in the lowered position adjacent to the chassis and the expanded condition in which the work platform is in the raised position remote above the chassis.

The sets of arms in the retracted condition of the lift mechanism are in a substantially stacked relationship with one another and in the expanded condition of the lift mechanism are in a substantially unstacked relationship with one another.

The actuation arrangement includes a ballscrew shaft, an upper joint, a lower joint and an electric motor. The upper joint pivotally and threadably couples an upper portion of the ballscrew shaft to the lower end of the lift mechanism for causing the lift mechanism to move between the expanded and retracted conditions upon rotation of the ballscrew shaft while permitting pivotal movement of the ballscrew shaft relative to the lift mechanism as the lift mechanism is moved between the expanded and retracted conditions. The upper joint is centrally disposed between the lower one of the sets of arms of the lift mechanism. The lower joint couples a lower portion of the ballscrew shaft to the chassis for undergoing limited universal pivotal movement of the ballscrew shaft relative to the chassis as the lift mechanism is moved between the expanded and retracted conditions. The electric motor is drivingly coupled to the lower portion of the ballscrew shaft below the lower joint of the actuation arrangement. The electric motor has a gearbox defining a sleeve receiving and drivingly coupled with the lower portion of the ballscrew shaft of the actuation arrangement. The sleeve is rotatable by the gearbox and driven by the electric motor for causing rotation of the ballscrew shaft between the first and second angular directions. The ballscrew shaft of the actuation arrangement is positioned at an angle of between 20 to 40 degrees relative to a horizontal when the lift mechanism is in the retracted condition and is positioned at an angle of between 50 to 70 degrees relative to a horizontal when the lift mechanism is in the expanded condition.

These and other features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the following detailed description, reference will be made to the attached drawings in which.

DETAILED DESCRIPTION OF THE INVENTION

Figure 1:
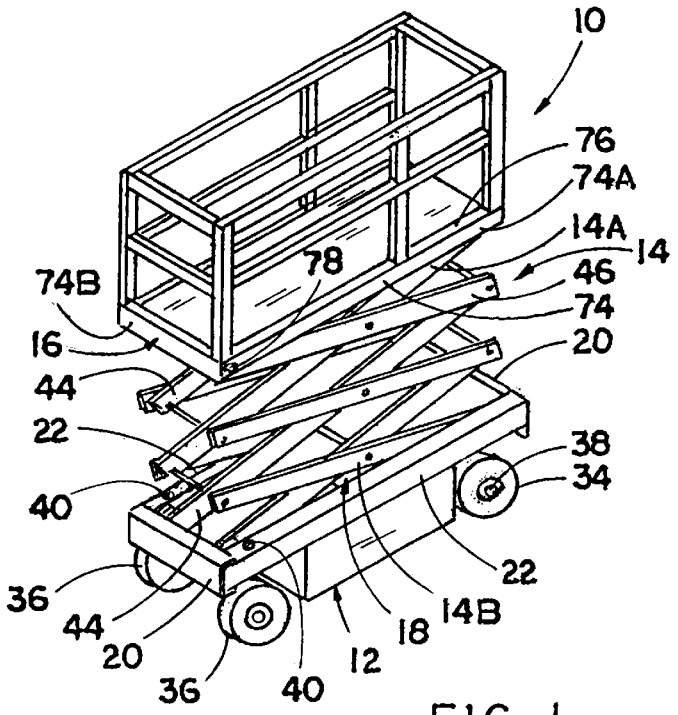
FIG. 1 is a perspective view of a scissors-type lift machine incorporating an electro-mechanical based lift mechanism actuation arrangement in accordance with the principles of the present invention.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

Referring to the drawings and particularly to FIGS. 1 to 7, there is illustrated an electro-mechanical based work platform lift machine, generally designated 10, of the present invention. The lift machine 10 basically includes a chassis 12, a scissors lift mechanism 14 having an upper end 14A and a lower end 14B mounted on the chassis 12, a work platform 16 mounted on the upper end 14A of the lift mechanism 14, and an electro-mechanical actuation arrangement 18 for operating the lift mechanism 14 between retracted and expanded conditions so as to move the work platform 16 between lowered and raised positions. The electro-mechanical actuation arrangement 18 is mounted to and extends between the chassis 12 and the lower end 14B of the lift mechanism 14. The actuation arrangement 18 is operable to rotate in a first angular direction and cause movement of the lift mechanism 14 vertically downward toward the retracted condition and thereby movement of the work platform 16 toward the lowered position and to rotate in a second angular direction opposite to the first angular direction and cause movement of the lift mechanism 14 vertically upward toward the expanded condition and thereby movement of the work platform 16 toward the raised position.

Referring now to FIGS. 1 to 4 and 8, the chassis 12 includes a pair of opposite end members 20, a pair of opposite side members 22, a platform 24 and a pair of opposite side panels 26. Each end member 20 has a substantially C-shaped configuration in transverse cross-section, though it may have any other suitable configuration. Each side member 22 has a substantially rectangular configuration in transverse cross-section, though it may have any other suitable configuration, and has a length substantially greater than the length of the end member 20 whereby the overall length of the chassis is substantially greater than its width. The longitudinally extending side members 22 at their respective opposite ends 22A, 22B are connected to the opposite ends 20A, 20B of the transversely extending end members 20 to thereby provide the chassis 12 with a substantially rectangular configuration. Each side member 22 defines an inboard channel 28 facing the other of the side members 22 and extending approximately half the length thereof and from the one end 22A thereof. Each side member 22 further has an inboard bracket 29 with a hole 30 and being mounted adjacent to the one end member 20 at the ends 22B of the side members 22. The platform 24, being of substantially flat and rectangular configuration though it may have any other suitable configuration, has a length substantially greater than its width. The platform 24 disposed centrally and longitudinally of the chassis 12 is mounted to and between the opposite side members 22. The central longitudinal platform 24 defines an opening 32 disposed at a central location thereof but slightly closer to the ends 22B than to the ends 22A of the side members 22. Each side panel 26 has a substantially flat and rectangular configuration, though it may have any other suitable configuration, and has a length substantially greater than a width thereof and less than the length of the central longitudinal platform 24. Each side panel 26 is mounted to and extends vertically downwardly below and from one of the side members 22 at a central location therealong. Each side panel 26 mounts a collar 33 on an interior side thereof and facing the other of the side panels 26. Each collar 33 is disposed at a central location on the one of the side panels 26. The chassis 12 further includes rear stationary wheels 34 and front steerable wheels 36 and is thereby mobile. The rear stationary wheels 34 are mounted to opposite ends of a rear axle 38 which in turn is mounted below the ends 22A of the side members 22 adjacent to rear end member 20. The front steerable wheels 36 are mounted to front axles 40 which in turn are mounted to and disposed below the ends 22B of the side members 22 adjacent to the front end member 20. The wheels 34 are disposed adjacent to ends of the side panels 26 opposite from the wheels 36.

Figure 2:
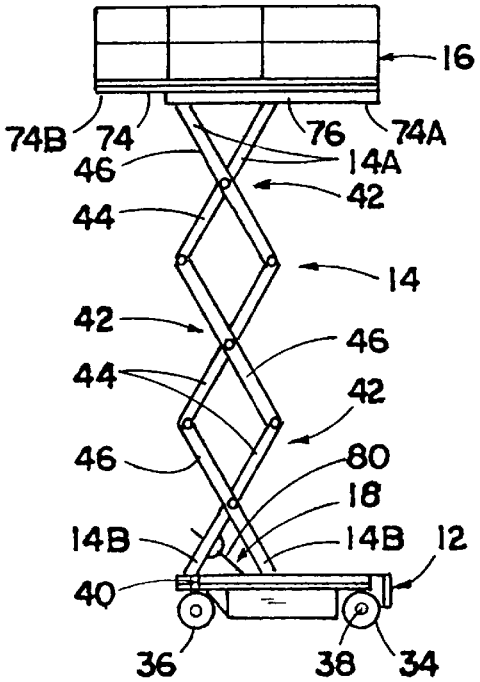
FIG. 2 is a side elevational view of the lift machine of FIG. 1 showing its scissors lift mechanism in an expanded condition and its work platform in a raised position by operation of its electro-mechanical actuation arrangement.
Figure 3:
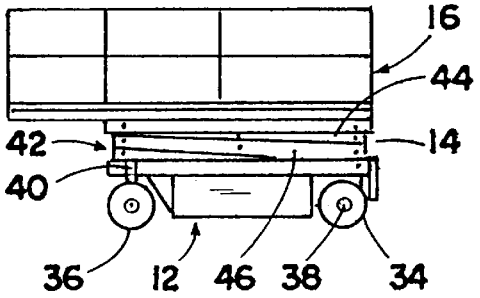
FIG. 3 is a side elevational view of the lift machine of FIG. 1 showing its scissors lift mechanism in a retracted condition and its work platform in a lowered position by operation of its electro-mechanical actuation arrangement.
Figure 4:
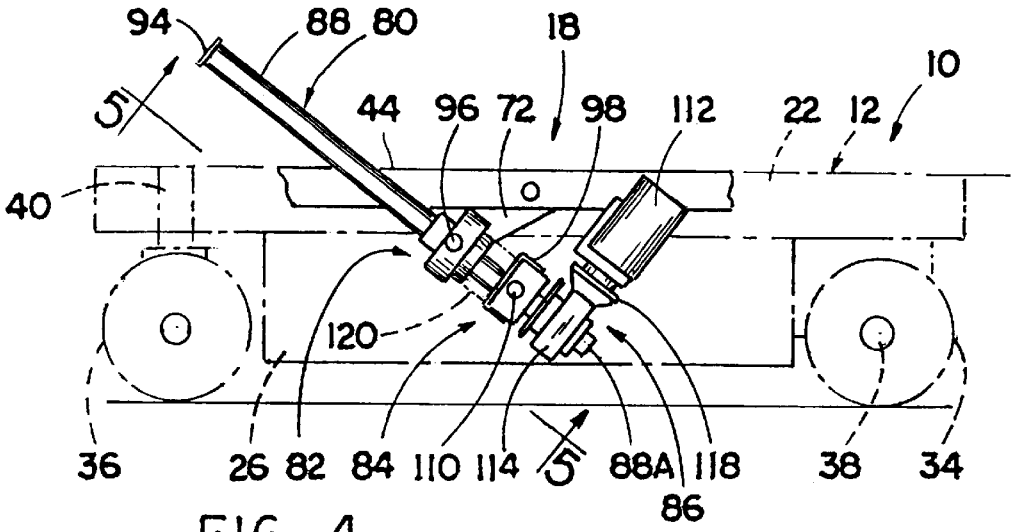
FIG. 4 is an enlarged side elevational view of the electro-mechanical actuation arrangement mounted on a mobile chassis of the lift machine being shown in phantom.
Figure 5:
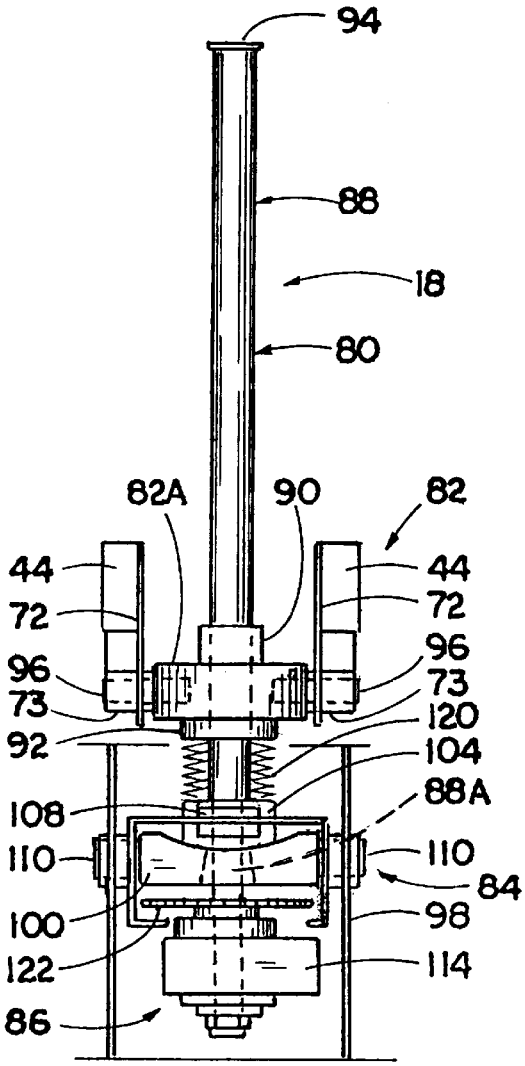
FIG. 5 is an enlarged bottom plan view of the electro-mechanical actuation arrangement as seen along line 5—5 of FIG. 4.

Referring now to FIGS. 1 to 3, 8 and 9, the lift mechanism 14 is of a type conventional per se in the art. The lift mechanism 14 extends vertically between the chassis 12 and work platform 16. The lift mechanism 14 includes a plurality of sets of arms 42 pivotally interconnected in a vertically extending scissor-like fashion with a lower one of the sets of arms 42 pivotally and movably mounted on the chassis 12 and an upper one of the sets of arms 42 pivotally and movably mounting the work platform 16 such that pivoting of the sets of arms 42 relative to one another causes the lift mechanism 14 to move vertically downward and upward between a retracted condition in which the work platform 16 is in a lowered position adjacent to the chassis 12, as shown in FIG. 3, and an expanded condition in which the work platform 16 is in a raised position remote above the chassis 12, as shown in FIG. 2. As is readily apparent with reference to FIGS. 3 and 2 respectively, the sets of arms 42 in the retracted condition of the lift mechanism 14 are in a substantially stacked relationship with one another and in the expanded condition of the lift mechanism 14 are in a substantially unstacked relationship with one another.

More particularly, each set of arms 42 of the lift mechanism 14 includes a pair of inside arms 44 and a pair of outside arms 46. Each inside arm 44 is of a rigid hollow tubular construction having a substantially rectangular configuration in transverse cross-section, though it may have any other suitable configuration, and has a length similar to the length of one of the side members 22 of the chassis 12. Each inside arm 44 has opposite ends 44A, 44B and is disposed in substantially parallel relation to the other inside arm 44 of the pair. Each inside arm 44 has a center hole 48 defined substantially at a midpoint thereof and respective end holes 50, 52 defined adjacent to the opposite ends 44A, 44B thereof. The lift mechanism 14 also includes a plurality of rigid long hollow central and end tubes 54, 56 extending between the pair of inside arms 44 and secured respectively through their aligned center holes 48 and through their aligned end holes 50 at the one ends 44A of the inside arms 44. The lift mechanism 14 further includes rigid short tubes or pins 58 secured through each of the end holes 52 at the opposite ends 44B of the inside arms 44 and also extending beyond the outboard sides of the respective inside arms 44 to provide pivot elements for pivotally coupling with the corresponding ends of the outside arms 46 respectively positioned outboard of the inside arms 44 or in the case of the lower and upper sets of arms 42 pivotally coupled with the chassis 12 and work platform 16.

Each outside arm 46 also is of a rigid hollow tubular construction having a substantially rectangular configuration in transverse cross-section, though it may have any other suitable configuration, and has a length substantially the same as the length of each inside arm 44. Each outside arm 46 has opposite ends 46A, 46B and is disposed in substantially parallel relation to the other outside arm 46 of the pair and along the outboard side of a respective one of the inside arms 44. Each outside arm 46 has a center hole 60 defined substantially at a midpoint thereof and respective end holes 62, 64 defined adjacent to the opposite ends 46A, 46B thereof. The lift mechanism 14 further includes a plurality of sets of elongated cylindrical pins 66. The pins 66 extend through the long central and end tubes 54, 56 of the pair of inside arms 44 and have opposite ends 66A extending beyond the opposite ends 54A, 56A of the tube 54, 56 and are received and secured through the center and end holes 60, 64 of the outside arms 46 so as to pivotally couple and connect the inside and outside arms 44, 46 of the respective sets to one another. Rigid short tubes or pins 58 are also secured through each of the end holes 62 at the opposite ends 46B of the outside arms 46 and also extending beyond the outboard sides of the respective outside arms 46 to mount slide rollers 68 for pivotally and movably coupling the outside arms 46 of upper and lower sets of arms 42 with the chassis 12 and work platform 16. Also, the lower pair of inside arms 44 are rigidly interconnected to one another by a cross connecting member 70. The cross connecting member 70 has a substantially rectangular configuration similar to each inside arm 44 and is mounted to and disposed between inboard sides of lower inside arms 44 closer to the ends 44B than to the ends 44A. The short end tubes or pins 58 of the lower and upper inside arms 44 are received by the holes of 30 of the inboard brackets 29 to pivotally mount the lower and upper inside arms 44 adjacent their ends 44B to the chassis 12 and work platform 16. The slide rollers 68 of the lower and upper outside arms 46 are received and captured by the inboard channels 28 of the chassis 12 to pivotally and translationally movably mount the lower and upper outside arms 46 at their ends 46A to the chassis 12 and work platform 16. In this arrangement, the ends 44B of the lower inside arms 44 are stationary but pivot in relation to the side members 22 of the chassis 12 and the ends 46A of the lower outside arms 46 are slidable in relation to the side members 22 of the chassis 12 and thereby allow for expansion and retraction of the lift mechanism 14. Each lower inside arm 44 also has a gusset plate 72 which extends vertically downwardly therefrom and is disposed adjacent to the midpoint of the inside arm 44 but slightly closer to the end 44B than to the end 44A. Each gusset plate 72 has a hollow collar 73 defined thereon for pivotally coupling with the elements of the actuation arrangement 18 which will be described below.

By the above-described assembly of the inside arms 44 and outside arms 46, adjacent inside arms 44 and outside arms 46 form an "X" configuration in relation to one another. Each "X" subassembly which comprises adjacent pairs of inside arms 44 and outside arms 46 may be referred to as a scissors section. The lift mechanism 14 can be of any suitable size, though typically ranges from fifteen to thirty-five feet in height, which depends on the expanded height of each scissors section and the number of sections comprising the lift mechanism 14. For illustration purposes, the machine 10 shown in FIGS. 1 to 3 is capable of reaching a vertical height of twenty feet and includes three scissor sections.

The work platform 16 is of any suitable type such as the one shown in FIG. 1. An underside of the work platform 16 is mounted to the upper set of inside and outside arms 44, 46 in a fashion substantially similar to the mounting of the lower set of inside and outside arms 44, 46 to the side members 22 of the chassis 12. The underside of the work platform 16 includes a pair of opposite side members 74. Each side member 74 has opposite ends 74A, 74B and defines a channel 76 and a hole 78 which are similar to the channel 28 and hole 30 of each side member 22 of the chassis 12. The channels 76 of the side members 74 receive and capture the slide rollers 68 of the upper outside arms 46. The holes 78 of the side members 74 receive the pins 58 on the upper inside arms 44. The side members 22 of the chassis 12 and side members 74 of the work platform 16 thereby operate with the sets of arms 42 in a similar fashion to allow for expansion and retraction of the lift mechanism 14.

Figure 6:
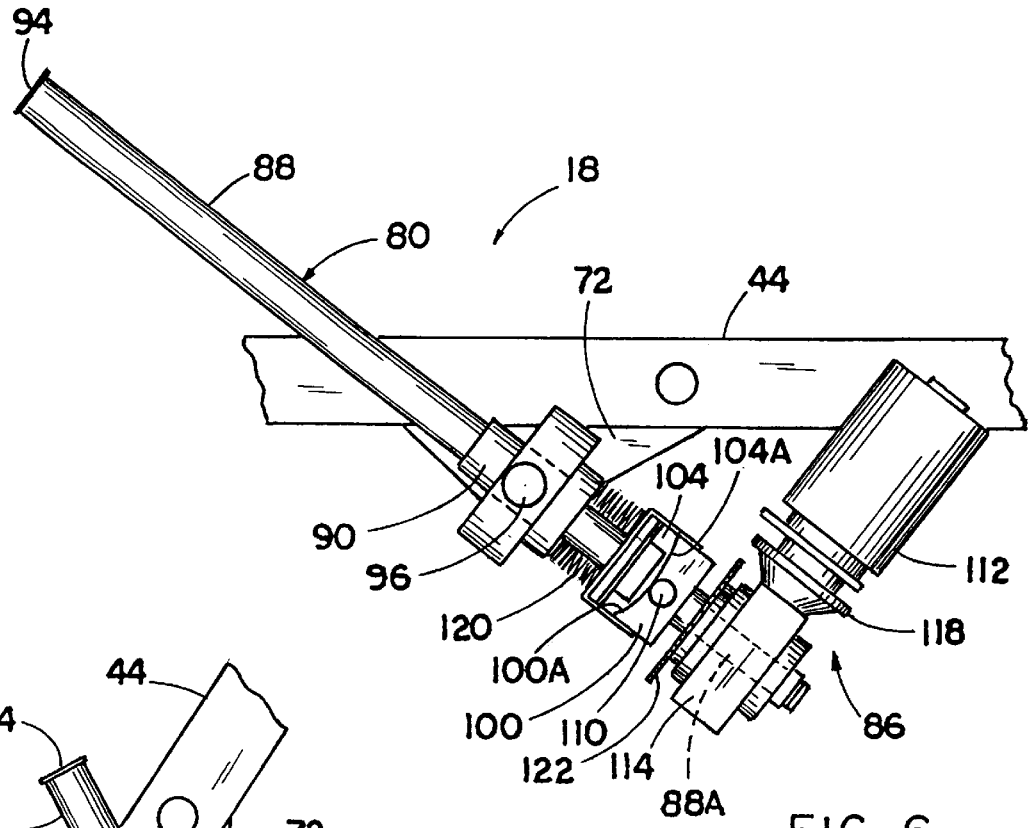
FIG. 6 is a side elevational view of the electro-mechanical actuation arrangement of FIG. 4 on a larger scale showing the arrangement in a retracted mode.
Figure 7:
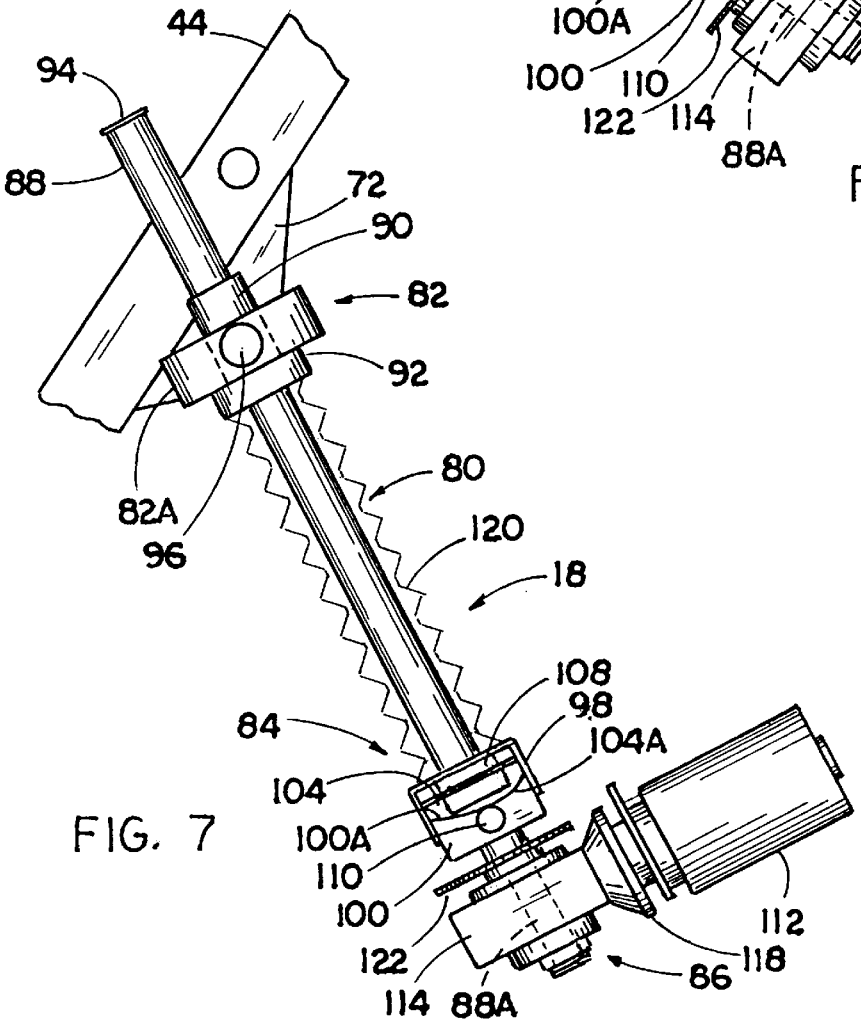
FIG. 7 is a side elevational view of the electro-mechanical actuation arrangement similar to FIG. 6 but showing the arrangement in an expanded mode.
Figure 8:
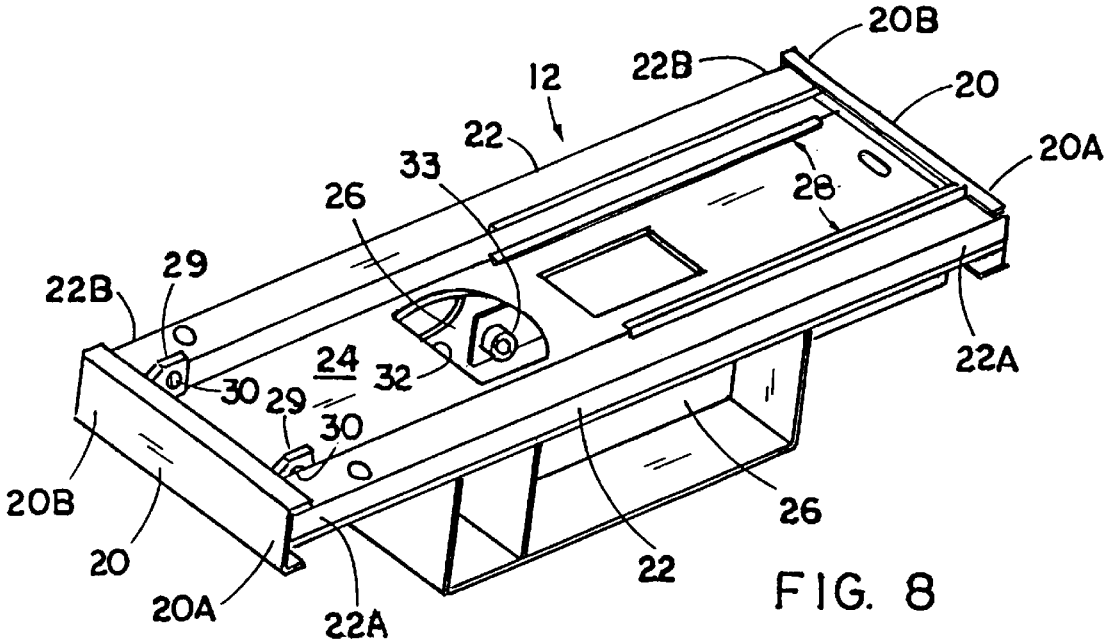
FIG. 8 is an enlarged perspective view of the chassis of the lift machine with the wheels omitted.
Figure 9:
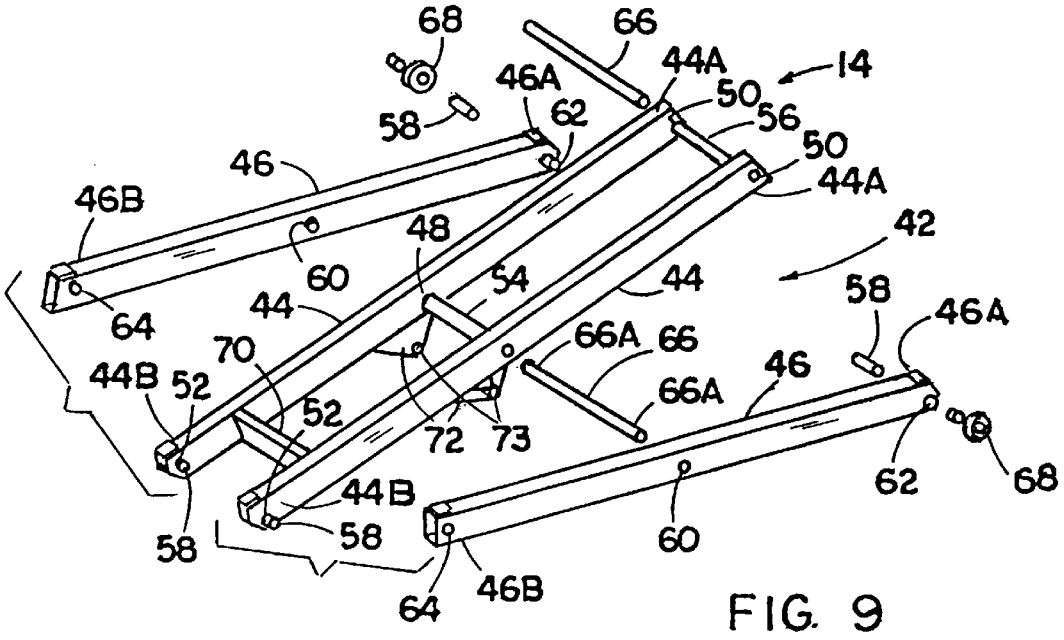
FIG. 9 is an enlarged perspective exploded view of a portion of the scissors lift mechanism of the lift machine.
Figure 10:
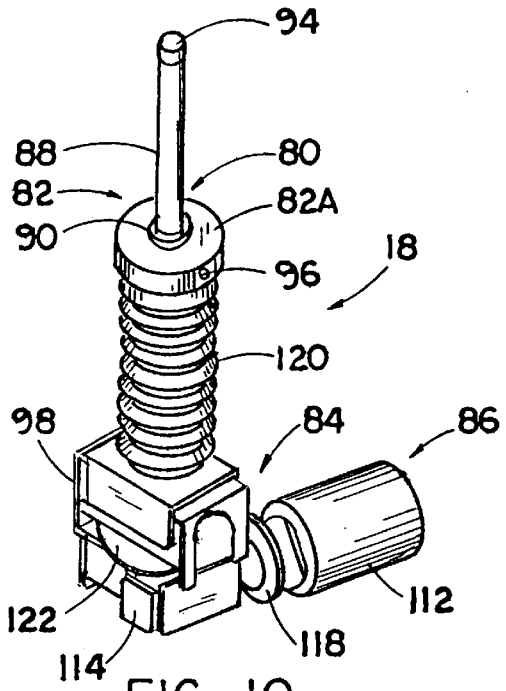
FIG. 10 is another perspective view of the electro-mechanical actuation arrangement showing an electric motor, brake, gearbox, ballscrew shaft, universal ball joint and pivot joint thereof.
Figure 11:
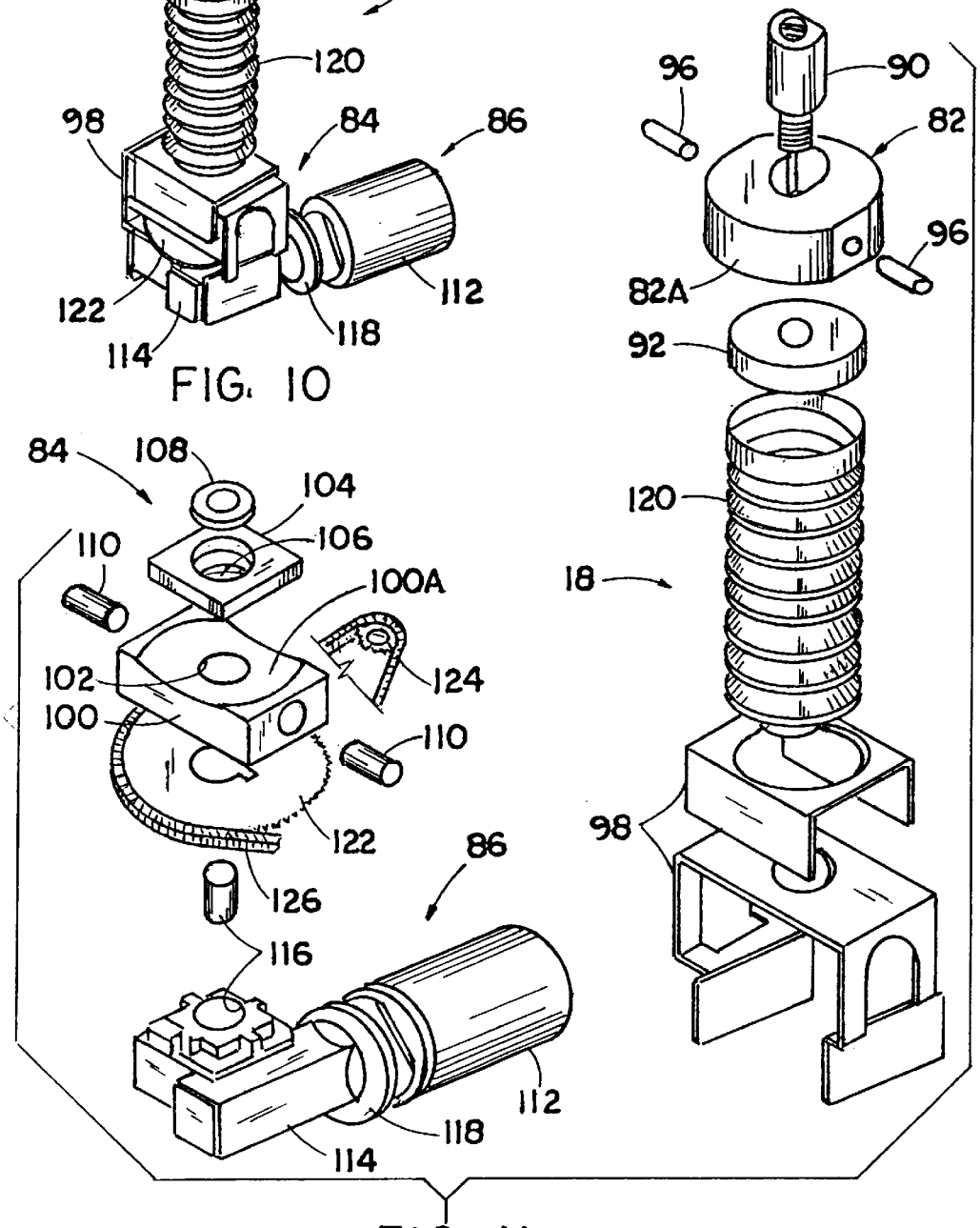
FIG. 11 is an enlarged exploded view of the electro-mechanical actuation arrangement of FIG. 10.
Figure 14:
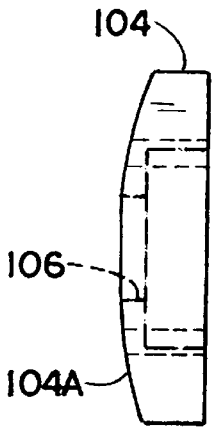
FIG. 14 is a side elevational view of the ball bearing block as seen along line 14—14 of FIG. 12.
Figure 12:
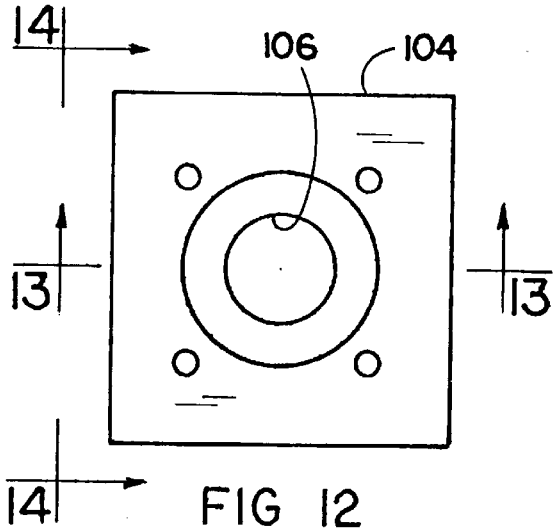
FIG. 12 is an enlarged top plan view of a ball bearing block of a universal ball joint of the electro-mechanical actuation arrangement of FIG. 11.
Figure 13:
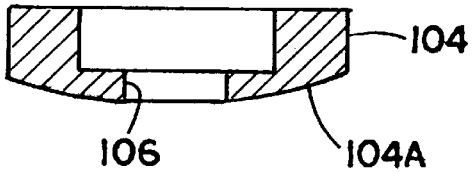
FIG. 13 is a cross-sectional view of the ball bearing block taken along line 13—13 of FIG. 12.
Figure 15:
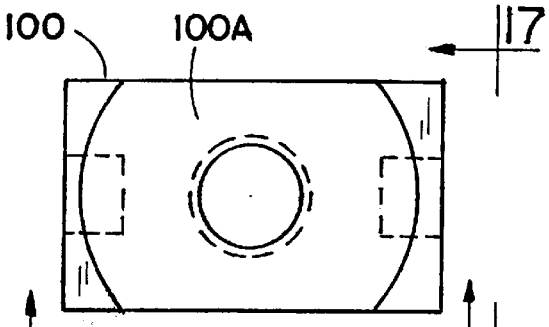
FIG. 15 is an enlarged top plan view of a ball support block of the universal ball joint of the electro-mechanical actuation arrangement of FIG. 11.
Figure 17:
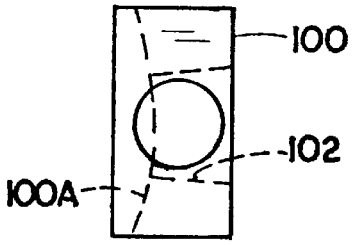
FIG. 17 is an end elevational view of the ball support block as seen along line 17—17 of FIG. 15.
Figure 16:
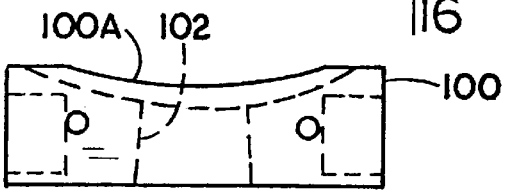
FIG. 16 is a side elevational of the ball support block as seen along line 16—16 of FIG. 15.
Figure 18:
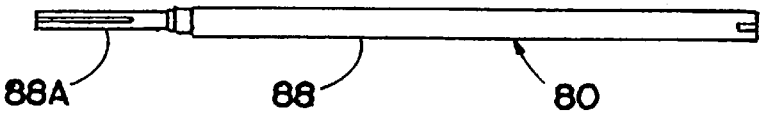
FIG. 18 is a side elevational view of a ballscrew shaft of the electro-mechanical actuation arrangement of FIG. 10.

Referring now to FIGS. 1 to 18, the actuation arrangement 18 includes a ballscrew shaft 80, an upper joint 82, a lower joint 84 and a drive means 86. The ballscrew shaft 80, which per se may be a commercial available item, such as model 5 BSJ sold under the "Actionjac" trademark, is operable to rotate in the first angular direction and cause movement of the lift mechanism 14 vertically toward the retracted condition and thereby movement of the work platform 16 toward the lowered position and to rotate in the second angular direction opposite to the first angular direction and cause movement of the lift mechanism 14 vertically toward the expanded condition and thereby movement of the work platform 16 toward the raised position. The ballscrew shaft 80 is positioned at an angle of between 20 to 40 degrees relative to a horizontal reference when the lift mechanism 14 is in the retracted condition, as shown in FIG. 6, and is positioned at an angle of between 50 to 70 degrees relative to the horizontal reference when the lift mechanism 14 is in the expanded condition, as shown in FIG. 7. The ballscrew shaft 80 includes an externally threaded shaft 88, an internally threated nut 90 engaged on the threaded shaft 88, a flange retainer 92 engaged on the threaded shaft 88 and an end cap 94 mounted on a top end of the threaded shaft 88. The upper joint 82 pivotally and threadably couples an upper portion of the threaded shaft 88 to the lower end of the lift mechanism 14 for causing the lift mechanism 14 to move between the expanded and retracted conditions upon rotation of the ballscrew shaft 80 while permitting pivotal movement of the ballscrew shaft 80 relative to the lift mechanism 14 as the lift mechanism 14 is moved between the expanded and retracted conditions. The upper joint 82 is annular shaped and has a continuous side wall 82A and a pair of pins 96 mounted to and extending outwardly from opposite sides of the side wall 82A. The pins 96 are inserted into the collars 73 of the gusset plates 72 of the lower inside arms 44 of the lift mechanism 14 such that the ballscrew shaft 80 is operable therewith. The upper joint 82 is centrally disposed between the lower inside arms 44 of the lift mechanism 14. The flange retainer 92 is attached to an underside of the upper joint 82. The nut 90 fits within the upper joint 82 and is secured into the retainer flange 92 therebelow. The nut 90 is threadably received on the threaded shaft 88 such that rotation of the shaft 88 causes pivotal movement of the lower inside arms 44 which are pivotally coupled to and stationary hold the nut 90 relative to the threaded shaft 88. The end cap 94 applied on the end of the threaded shaft 88 provides an end stop preventing the threaded shaft 88 from totally unthreading from the nut 90. Depending upon the direction of rotation of the threaded shaft 88, the lower set of arms 42 of the lowest scissors section is either pivoted away from the chassis 12 to raise the work platform 16, or, pivoted toward the chassis 12 to retract the lift mechanism 14 and thereby lower the work platform 16 from its elevated position.

The lower joint 84 couples a lower portion of the threaded shaft 88 of the ballscrew shaft 80 to the chassis 12 for undergoing limited universal pivotal movement of the ballscrew shaft 80 relative to the chassis 12 as the lift mechanism 14 is moved between the expanded and retracted conditions. The lower joint 84 includes an outer housing 98, a ball support block 100 attached to the outer housing 98 and having a central bore 102 receiving an unthreaded lower end portion 88A of the shaft 88 of the ballscrew shaft 80 therethrough, a ball bearing block 104 attached to the outer housing 98 overlying the ball support block 100 and having a central hole 106 receiving the unthreaded lower end portion 88A of the shaft 88 therethrough, a thrust bearing 108 receiving therethrough and rotatably engaging the unthreaded lower end portion 88A of the shaft 88 of the ballscrew shaft 80, and a pair of support pins 110 mounted to and extending outwardly from and on opposite sides of the ball support block 100. The thrust bearing 108 fits into the ball bearing block 104. The ball support block 100 and the ball bearing block 104 comprise the limited universal ball joint. The ball support block 100 has a concave top surface 100A and defines the central bore 102 having a cone-shaped configuration which allows for side-to-side pivotal movement of the lower end portion 88A of the shaft 88 of the ballscrew shaft 80 as the ball bearing block 104 at its convex-shaped bottom 104A moves swivel-like about the concave top surface 100A of the ball support block 100 so as to compensate for side loading of the ballscrew shaft 80. The pins 110 are rotatably received in the collars 33 on the side panels 26 of the chassis 12.

The drive means 86 includes an electric motor 112 and a gearbox 114 supporting the electric motor 112 and in turn mounted to the outer housing 98 of the lower joint 84. The gearbox 114 drivingly couples the electric motor 112 to the unthreaded lower end portion 88A of the ballscrew shaft 80 below the lower joint 84. The gearbox 114 has an internal sleeve 116 receiving and keyed to the lower end portion 88A of the threaded shaft 88 of the ballscrew shaft 80. The sleeve 116 is rotatable by the gearbox 114 as driven by the electric motor 112 for causing selected rotation of the ballscrew shaft 80 between the first and second angular directions. The electric motor 112 further has a matrix brake 118 disposed between the motor 112 and gearbox 114. The actuation arrangement 18 further includes a dust boot 120 mounted between the upper and lower joints 82, 84 for covering an otherwise exposed portion of the threaded shaft 88 of the ballscrew shaft 80.

For manually rotating the ballscrew 80, the actuation arrangement 18 also includes a first sprocket 122 receiving and keyed on the unthreaded lower end portion 88A of the shaft 88 of the ballscrew shaft 80 and located between the gearbox 114 and the lower ball support block 100, a second sprocket 124 having a smaller diameter than the first sprocket 122 and laterally displaced therefrom, and a link chain 126 entrained about and drivingly engaged with the first and second sprockets 122,124. The second sprocket 124 is attached to another gearbox (not shown) for connection to a hand handle (not shown) for turning by an operator to rotate the shaft 88 of the ballscrew shaft 80 if the electric motor 112 should fail to operate.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiments thereof.

I claim:

1. A scissors work platform lift machine, comprising:

(a) a chassis;

(b) a scissors lift mechanism having an upper end and a lower end mounted on said chassis;

(c) a work platform mounted on said upper end of said lift mechanism; and (d) an electro-mechanical actuation arrangement for operating said lift mechanism between retracted and expanded conditions so as to move said work platform between lowered and raised positions, said electro-mechanical actuation arrangement being mounted to and extending between said chassis and said lower end of said lift mechanism and including a ballscrew shaft operable to rotate in a first angular direction and cause movement of said lift mechanism vertically toward said retracted condition and thereby movement of said work platform toward said lowered position and to rotate in a second angular direction opposite to said first angular direction and cause movement of said lift mechanism vertically toward said expanded condition and thereby movement of said work platform toward said raised position, said actuation arrangement further including a lower joint coupling a lower portion of said ballscrew shaft to said chassis for undergoing limited universal pivotal movement of said ballscrew shaft relative to said chassis as said lift mechanism is moved between said expanded and retracted conditions, said lower joint including (i) a ball support block having a pair of support pins mounted to and extending outwardly from and on opposite sides thereof for rotatable connection with a respective pair of collars mounted to said chassis; and (ii) a ball bearing block overlying said ball support block in forming a ball joint;

(iii) said lower portion of said ballscrew shaft extending through said ball joint formed by said ball bearing block and said ball support block and adapted to move in a universal direction.

2. The machine as recited in claim 1, wherein said chassis includes rear stationary wheels and front steerable wheels and is thereby mobile.

3. The machine as recited in claim 1, wherein said actuation arrangement further includes an upper joint pivotally and threadably coupling an upper portion of said ballscrew shaft to said lower end of said lift mechanism for causing said lift mechanism to move between said expanded and retracted conditions upon rotation of said ballscrew shaft while permitting pivotal movement of said ballscrew shaft relative to said lift mechanism as said lift mechanism is moved between said expanded and retracted conditions.

4. The machine as recited in claim 3, wherein said upper joint has said upper portion of said ballscrew shaft extending therethrough and said actuation arrangement further includes a pair of pins extending outwardly from opposite sides of a side wall of said upper joint for rotatable connection with a pair of respective collars mounted to said lower end of said lift mechanism.

5. The machine as recited in claim 4, wherein said actuation arrangement further includes a ballscrew nut threadably received by said upper portion of said ballscrew shaft, said ballscrew nut being secured to said upper joint.

6. The machine as recited in claim 1, wherein said ball support block has a concave top surface and a central bore with a cone-shaped configuration which allows for side-to-side pivotal movement of the lower end portion of the ballscrew shaft; and said ball bearing block has a convex bottom surface which permits swivel-like motion about the concave top surface of said ball support block so as to compensate for side loading of the ballscrew shaft during raising and lowering of said lift mechanism by said actuation arrangement.

7. The machine as recited in claim 1, wherein said actuation arrangement further includes an electric motor drivingly coupled to said lower portion of said ballscrew shaft below said lower joint of said actuation arrangement.

8. The machine as recited in claim 7, wherein said electric motor of said actuation arrangement has a gearbox defining a sleeve receiving and drivingly coupled with said lower portion of said ballscrew shaft of said actuation arrangement, said sleeve being rotatable by said gearbox and driven by said electric motor for causing rotation of said ballscrew shaft between said first and second angular directions.

9. The machine as recited in claim 1, wherein said ballscrew shaft of said actuation arrangement is positioned at an angle of between 20 to 40 degrees relative to a horizontal reference when said lift mechanism is in said retracted condition.

10. The machine as recited in claim 1, wherein said ballscrew shaft of said actuation arrangement is positioned at an angle of between 50 to 70 degrees relative to a horizontal reference when said lift mechanism is in said expanded condition.

11. A scissors work platform lift machine, comprising:

(a) a chassis;

(b) a work platform disposed above said chassis;

(c) a scissors lift mechanism extending vertically between said chassis and said work platform, said lift mechanism including a plurality of sets of arms pivotally interconnected in a vertically extending scissor-like fashion with a lower one of said sets of arms pivotally and movably mounted on said chassis and an upper one of said sets of arms pivotally and movably mounting said work platform such that pivoting of said sets of arms relative to one another causes said lift mechanism to move vertically between a retracted condition in which said work platform is in a lowered position adjacent to said chassis and an expanded condition in which said work platform is in a raised position remote above said chassis, said sets of arms in said retracted condition of said lift mechanism being in a substantially stacked relationship with one another and in said expanded condition of said lift mechanism being in a substantially unstacked relationship with one another; and (d) an electro-mechanical actuation arrangement mounted to and extending between said chassis and said lift mechanism and being operable to rotate in a first angular direction and cause movement of said lift mechanism vertically toward said retracted condition and thereby movement of said work platform toward said lowered position and to rotate in a second angular direction opposite to said first angular direction and cause movement of said lift mechanism vertically toward said expanded condition and thereby movement of said work platform toward said raised position, said actuation arrangement further including a lower joint coupling a lower portion of said actuation arrangement to said chassis for undergoing limited universal pivotal movement of said actuation arrangement relative to said chassis as said lift mechanism is moved between said expanded and retracted conditions, said lower joint including (i) a ball support block having a pair of support pins mounted to and extending outwardly from and on opposite sides thereof for rotatable connection with a respective pair of collars mounted to said chassis; and (ii) a ball bearing block overlying said ball support block in forming a ball joint;

(iii) said lower portion of said ballscrew shaft extending through said ball joint formed by said ball bearing block and said ball support block and adapted to move in a universal direction.

12. The machine as recited in claim 11, wherein said chassis includes rear stationary wheels and front steerable wheels and is thereby mobile.

13. The machine as recited in claim 11, wherein said actuation arrangement includes an upper joint pivotally coupling an upper portion of said actuation arrangement to said lower end of said lift mechanism for causing said lift mechanism to move between said expanded and retracted conditions upon rotation of said actuation arrangement while permitting pivotal movement of said actuation arrangement relative to said lift mechanism as said lift mechanism is moved between said expanded and retracted conditions.

14. The machine as recited in claim 13, wherein said upperjoint of said actuation arrangement is centrally disposed between said lower one of said sets of arms of said lift mechanism.

15. The machine as recited in claim 11, wherein said ball support block has a concave top surface and a central bore with a cone-shaped configuration which allows for side-to-side pivotal movement of the lower end portion of the ballscrew shaft; and said ball bearing block has a convex bottom surface which permits swivel-like motion about the concave top surface of said ball support block so as to compensate for side loading of the ballscrew shaft during raising and lowering of said lift mechanism by said actuation arrangement.

16. The machine as recited in claim 11, wherein said actuation arrangement further includes an electric motor drivingly coupled to said lower portion of said actuation arrangement below said lower joint of said actuation arrangement.

17. The machine as recited in claim 11, wherein said actuation arrangement is positioned at an angle of between 20 to 40 degrees relative to a horizontal reference when said lift mechanism is in said retracted condition.

18. The machine as recited in claim 11, wherein said actuation arrangement is positioned at an angle of between 50 to 70 degrees relative to a horizontal reference when said lift mechanism is in said expanded condition.

19. A scissors work platform lift machine, comprising:

(a) a chassis;

(b) a work platform disposed above said chassis;

(c) a scissors lift mechanism extending vertically between said chassis and said work platform, said lift mechanism including a plurality of sets of arms pivotally interconnected in a vertically extending scissor-like fashion with a lower one of said sets of arms pivotally and movably mounted on said chassis and an upper one of said sets of arms pivotally and movably mounting said work platform such that pivoting of said sets of arms relative to one another causes said lift mechanism to move vertically between a retracted condition in which said work platform is in a lowered position adjacent to said chassis and an expanded condition in which said work platform is in a raised position remote above said chassis, said sets of arms in said retracted condition of said lift mechanism being in a substantially stacked relationship with one another and in said expanded condition of said lift mechanism being in a substantially unstacked relationship with one another; and (d) an electro-mechanical actuation arrangement for operating said lift mechanism between retracted and expanded conditions so as to move said work platform between lowered and raised positions, said electro-mechanical actuation arrangement being mounted to and extending between said chassis and said lower end of said lift mechanism and including (i) a ballscrew shaft operable to rotate in a first angular direction and cause movement of said lift mechanism vertically toward said retracted condition and thereby movement of said work platform toward said lowered position and to rotate in a second angular direction opposite to said first angular direction and cause movement of said lift mechanism vertically toward said expanded condition and thereby movement of said work platform toward said raised position, (ii) an upper joint pivotally and threadably coupling an upper portion of said ballscrew shaft to said lower end of said lift mechanism for causing said lift mechanism to move between said expanded and retracted conditions upon rotation of said ballscrew shaft while permitting pivotal movement of said ballscrew shaft relative to said lift mechanism as said lift mechanism is moved between said expanded and retracted conditions, (iii) a lower joint coupling a lower portion of said ballscrew shaft to said chassis for undergoing limited universal pivotal movement of said ballscrew shaft relative to said chassis as said lift mechanism is moved between said expanded and retracted conditions, said lower joint including a ball support block having a pair of support pins mounted to and extending outwardly from and on opposite sides thereof for rotatable connection with a respective pair of collars mounted to said chassis, said ball support block also having a concave top surface and a central bore with a cone-shaped configuration which allows for side-to-side pivotal movement of the lower end portion of the ballscrew shaft; and a ball bearing block overlying said ball support block in forming a ball joint, said ball bearing block having a convex bottom surface which permits swivel-like motion about the concave top surface of said ball support block so as to compensate for side loading of the ballscrew shaft during raising and lowering of said lift mechanism by said actuation arrangement, and (iv) an electric motor drivingly coupled to said lower portion of said ballscrew shaft below said lower joint.

20. The machine as recited in claim 19, wherein said upper joint has said upper portion of said ballscrew shaft extending therethrough and said actuation arrangement further includes a pair of pins extending outwardly from opposite sides of a sidewall of said upper joint for rotatable connection with a pair of respective collars mounted to said lower end of said lift mechanism; and a ballscrew nut threadably received by said upper portion of said ballscrew shaft, said ballscrew nut being secured to said upper joint.

21. The machine as recited in claim 19, wherein said chassis includes rear stationary wheels and front steerable wheels and is thereby mobile.

22. The machine as recited in claim 19, wherein said upper joint of said actuation arrangement is centrally disposed between said lower one of said sets of arms of said lift mechanism.

23. The machine as recited in claim 19, wherein said electric motor of said actuation arrangement has a gearbox defining a sleeve receiving and drivingly coupled with said lower portion of said ballscrew shaft of said actuation arrangement, said sleeve being rotatable by said gearbox and driven by said electric motor for causing rotation of said ballscrew shaft between said first and second angular directions.

24. The machine as recited in claim 19, wherein said ballscrew shaft of said actuation arrangement is positioned at an angle of between 20 to 40 degrees relative to a horizontal reference when said lift mechanism is in said retracted condition.

25. The machine as recited in claim 19, wherein said ballscrew shaft of said actuation arrangement is positioned at an angle of between 50 to 70 degrees relative to a horizontal reference when said lift mechanism is in said expanded condition.

* * * * *